United States Patent [19]

Ogawa

[11] 4,181,258

[45] Jan. 1, 1980

[54] SPRAYER FOR REPAIRING REFRACTORY LINING

[75] Inventor: Minoru Ogawa, Nagoya, Japan

[73] Assignee: Quigley Company, Inc., New York, N.Y.

[21] Appl. No.: 888,716

[22] Filed: Mar. 21, 1978

[30] Foreign Application Priority Data

Mar. 23, 1977 [JP] Japan ..... 52-031164

[51] Int. Cl.[2] ..... B05B 13/06; B05C 7/02

[52] U.S. Cl. ..... 239/186; 118/317; 239/227

[58] Field of Search ..... 266/281; 264/30; 118/317, 323; 239/186, 187, 227, 288

[56] References Cited

U.S. PATENT DOCUMENTS

| | | | |
|---|---|---|---|
| 3,221,994 | 12/1965 | Chappell | 239/186 |
| 3,351,289 | 11/1967 | Demaison | 239/227 X |
| 3,799,445 | 3/1974 | Marino | 239/227 X |
| 3,827,633 | 8/1974 | Kouno et al. | 239/187 X |
| 4,085,894 | 4/1978 | Kubo et al. | 239/227 X |
| 4,106,760 | 8/1978 | Kono et al. | 118/317 X |

FOREIGN PATENT DOCUMENTS 421085 10/1968 Australia .

*Primary Examiner*—Bruce H. Stoner, Jr.
*Assistant Examiner*—Andres Kashnikow
*Attorney, Agent, or Firm*—Francis X. Murphy; Charles J. Knuth; Peter C. Richardson

[57] ABSTRACT

A sprayer for repairing a refractory lining comprising a vertical, axially movable and rotatable nozzle pipe; a stationary housing disposed about a portion of the pipe; a pair of parallel, connected turntables rotatably supported within the housing axial with and through which the pipe freely passes; motor-driven wheels mounted on the undersides of the turntables for supporting the pipe and driving it in either axial direction relative to the housing; and the combination of a first gear mounted on the upperside of one turntable coaxial with and through which the pipe freely passes intermeshed with a second, motor-driven gear mounted on the housing for rotating the pipe together with the wheels.

8 Claims, 3 Drawing Figures

SPRAYER FOR REPAIRING REFRACTORY LINING

BACKGROUND OF THE INVENTION

This invention relates to a sprayer for repairing a refractory lining material of a high temperature treating device. More specifically, the invention relates to an improvement of a device for spraying a refractory repairing material to the damaged portions of a refractory lining of a high temperature treating device, for example, a furnace or vessel used to refine metals such as steel, a vessel, such as a ladle, used to retain or convey a molten metal, a trough or pipe for passing molten metal, or a furnace for calcining or sintering various materials such as refractories or metals, in order to increase the durability of the lining.

These high temperature treating devices, namely the various furnaces or vessels used to refine metals or produce refractory bricks, are lined with a refractory lining material such as refractory bricks or monolithic refractories. These linings have a very short life because the operating conditions are extremely severe (e.g., the temperature is very high). One method now in use for prolonging the life of such a lining material is to repair it by spraying it with a repairing material such as a granular refractory. This repairing is usually carried out by spraying by means of pneumatic pressure a slurry of the granular refractory in a liquid such as water onto the damaged portions of the lining of the high temperature treating device heated at high temperatures.

The spraying device used in this spraying operation has been such that its nozzle pipe for discharging a repairing material was operated manually by the working personnel to spray the repairing material against the damaged portions. The operation is extremely dangerous because the device should be used close to the high temperature treating device heated at a high temperature. Furthermore, the operator must work under severe working conditions, for example, under strong heat of radiation. In the case of spraying against a converter, for example, the spraying sometimes must be done even when a sintering material or slag adheres to the upper surface of the tilted converter. At such a time, the sintering material or slag may sometimes fall onto the spraying pipe inserted into the furnace, and this is very dangerous. Attempts have therefore been made to automate the sprayer in various ways so that the operator can perform spraying without approaching the high temperature treating device heated at high temperatures. However, no completely satisfactory device has yet been built.

SUMMARY OF THE INVENTION

The present invention is a sprayer for repairing a refractory lining, said sprayer comprising a driving means for moving a nozzle pipe discharging a repairing material forward and backward and a rotating means for rotating said pipe together with said driving means. The driving means consists of wheels or gears or the like actuated by motors, which support and hold the nozzle pipe. The nozzle pipe is moved forward by their rotation, and backward by their reverse rotation. The rotating means consists of motor-driven wheels or gears, or a combination of these. Their rotating action causes the driving means supporting and holding the nozzle pipe to rotate about the pipe, thereby imparting a rotating motion to the pipe.

Accordingly, when spraying is carried out by using a nozzle pipe having nozzles fitted thereto for projecting a spraying material laterally with respect to the pipe, the pipe is extended forward by the driving means, thereby making it possible to repair the deep inside lateral surfaces of a high temperature treating device. By drawing the pipe backward by means of the driving device, the proximate portion, i.e., the vicinity of the exit of the high temperature treating device, can be repaired. Furthermore, the inside surrounding wall of the high temperature treating device can be repaired by rotating the pipe by the rotating means. In this way, the forward and backward movement and the rotation of the nozzle pipe make it possible to repair the entire inside surface of the high temperature treating device. When it is desired to repair the bottom surface of the high temperature treating device, a pipe is used which includes nozzles for projecting spraying material in the longitudinal direction of the pipe.

BRIEF DESCRIPTION OF THE DRAWINGS

An embodiment of the present invention is illustrated below by reference to the drawings, in which.

DESCRIPTION OF THE PREFERRED EMBODIMENTS

Figure 1:
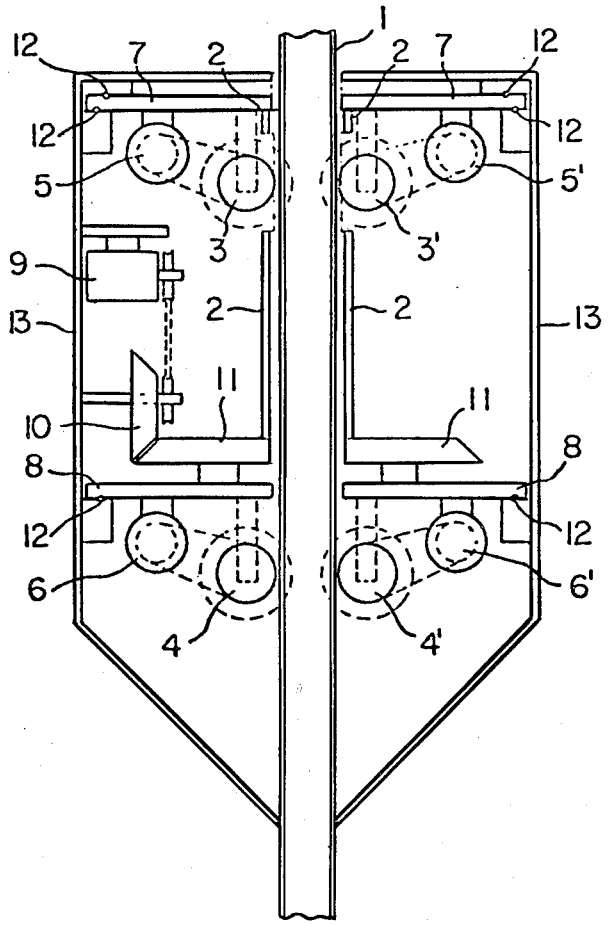
FIG. 1 is a schematic longitudinal sectional view of a spraying device for repairing a refractory lining in accordance with the invention.

As shown in FIG. 1, the driving means for the spraying device consists of wheels 3, 3', 4, 4' actuated by motors 5, 5', 6, 6', respectively. When wheels 3, 4 are rotated clockwise and wheels 3', 4' counterclockwise, nozzle pipe 1 for projecting a repairing material moves downward, i.e., forward. When these wheels are rotated in the reverse direction, nozzle pipe 1 moves upward, i.e., backward.

The rotating means consists of bevel gears 10, 11. By rotating gear 11 interlocked with gear 10 actuated by motor 9, nozzle pipe 1 engaged with drive wheels 3, 3', 4, 4' is rotated. At this time, gear 11, rotation pipe 2, motors 5, 5', 6, 6', drive wheels 3, 3', 4, 4', and turntables or rotation tables 7, 8, which support and hold motors 5, 5', 6, 6' and wheels 3, 3', 4, 4', rotate with nozzle pipe 1.

The spraying device is also provided with ball bearings 12 for rotating tables 7, 8, and with stationary housing or box 13 for protecting the device.

Figure 2:
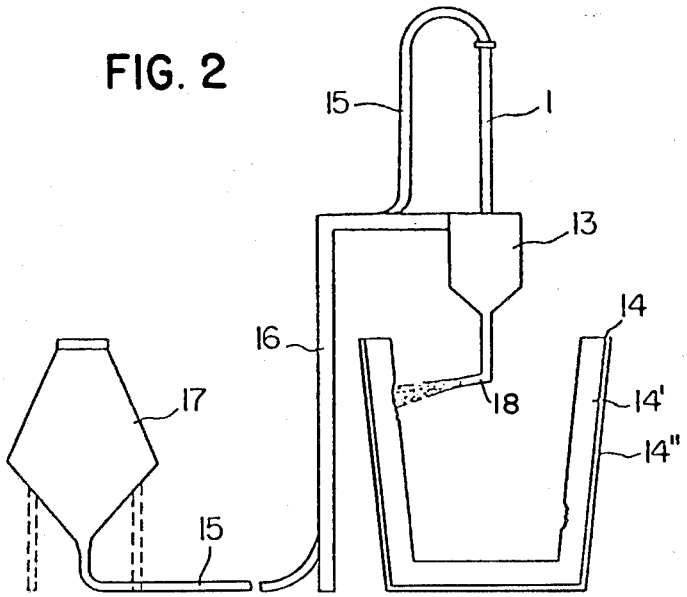
FIGS. 2 and 3 are schematic longitudinal sectional views showing an embodiment which uses the spraying device shown in FIG. 1.

In FIG. 2 is shown the spraying of a repairing material onto a damaged portion of ladle 14 at its upper left side, the repairing material being drawn from tank 17 containing a refractory repairing material through pressure hose 15 by the action of pneumatic pressure and passed through nozzle pipe 1 for spraying by a nozzle indicated generally by numeral 18. Box 13 includes therein the device of the invention shown in FIG. 1, and is supported by support device 16. Ladle 14 is made by lining an iron shell 14'' with bricks 14'.

Figure 3:
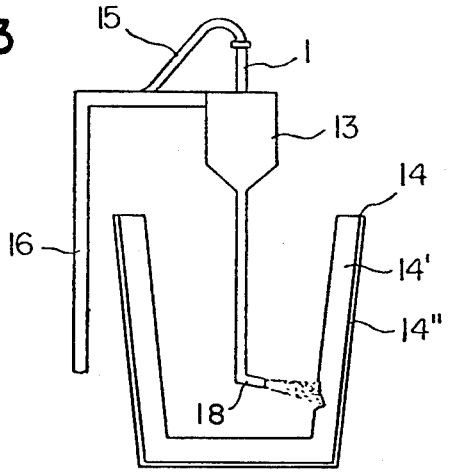

In FIG. 3 is shown the spraying of a refractory repairing material to a damaged portion of ladle 14 at its lower right side by extending nozzle pipe 1 downward. At this time, nozzle pipe 1 is moved downward by drive wheels 3, 3', 4, 4' and rotated by gears 10, 11 through a half turn.

As described hereinabove, the present invention provides a sprayer for repairing a refractory lining which permits the automation of the movement of a nozzle pipe for discharging a repairing material and makes it possible to perform the spraying of repairing material without approaching high temperature treating devices heated at high temperatures.

What is claimed is:

1. A spraying device for repairing a refractory lining, which comprises:

a nozzle pipe having a first end for receiving a slurry of a refractory repairing material and a second end at which a nozzle is to be fitted for spraying said slurry;

a stationary housing disposed about said nozzle pipe intermediate said first and second ends, said nozzle pipe being both rotatable about its axis and axially movable forward and backward relative to said housing;

a first turntable rotatably supported by and within said housing, said turntable being coaxial with said nozzle pipe and having a central opening between its two opposed major faces through which said nozzle pipe freely passes;

first pipe driving means mounted on one of said major faces of said turntable and engaged with said nozzle pipe, said driving means supporting said nozzle pipe relative to said housing and being actuable to drive said nozzle pipe in either axial direction of said nozzle pipe relative to said housing;

first actuating means secured to said one face of said turntable for actuating said driving means;

pipe rotating means comprising a first gear intermeshed with a second gear, said first gear being coaxially fixed to the other of said major faces of said turntable and having a central opening through which said nozzle pipe freely passes, said second gear having a drive shaft supported for rotation by said housing; and second actuating means secured to said housing for rotating said drive shaft to cause said second gear to rotate said first gear about said nozzle pipe axis together with said turntable carrying said driving means and said first actuating means, whereby said nozzle pipe and said turntable rotate in unison.

2. A spraying device according to claim 1, which comprises additionally:

a second turntable rotatably supported by and within said housing in spaced parallel relationship with said first turntable, said second turntable being coaxial with said nozzle pipe and having a central opening between its two opposed major faces through which said nozzle pipe freely passes;

second pipe driving means mounted on one of said major faces of said second turntable and engaged with said nozzle pipe, said second driving means augmenting said first driving means in supporting said nozzle pipe relative to said housing and also being actuable to drive said nozzle pipe in either axial direction of said nozzle pipe relative to said housing in cooperation with the actuation of said first driving means;

third actuating means secured to said one face of said second turntable for actuating said second driving means; and means rigidly connecting said turntables to one another so that the rotation of said first turntable is imparted to said second turntable.

3. A spraying device according to either of claims 1 or 2, wherein said turntable and nozzle pipe rotational axes are vertical.

4. A spraying device according to claim 3, wherein turntable supporting bearings are mounted on the inner wall of said housing.

5. A spraying device according to either of claims 1 or 2, wherein said driving means comprise wheels.

6. A spraying device according to either of claims 1 or 2, wherein said actuating means comprise motors.

7. A spraying device according to either of claims 1 or 2, wherein said first and second gears are bevel gears.

8. A spraying device according to either of claims 1 or 2, wherein said one major face of said turntable or turntables is the underface thereof.

* * * * *